US005636809A

United States Patent [19]

Koch

[11] Patent Number: 5,636,809

[45] Date of Patent: Jun. 10, 1997

[54] REEL CAGE

[75] Inventor: James Koch, 2315 Indian Rd. West, Minnetonka, Minn. 55343

[73] Assignee: James Koch, Minneapolis

[21] Appl. No.: 295,392

[22] Filed: Aug. 25, 1994

[51] Int. Cl.[6] ..... B65H 23/08; B65H 75/02

[52] U.S. Cl. ..... 242/422.5; 242/594.5; 242/559.4; 242/598.3; 242/598.6

[58] Field of Search ..... 242/422.5, 422.4, 242/594.5, 559.4, 598.5, 598.6, 557, 559.1, 129.6, 129.62, 129.8, 598.3

[56] References Cited

U.S. PATENT DOCUMENTS

| | | | |
|---|---|---|---|
| 195,883 | 10/1877 | Buzzell | 242/129.62 |
| 838,517 | 12/1906 | Bowser et al. | 242/422.5 |
| 1,112,692 | 10/1914 | Fraser | 242/129.6 |
| 1,526,087 | 2/1925 | Petersen | 242/422.5 X |
| 1,848,744 | 3/1932 | Pavlas | 242/129.6 |
| 2,841,343 | 7/1958 | Dorman | 242/571 |
| 4,383,398 | 5/1983 | Tipton | 242/594.5 X |
| 4,385,738 | 5/1983 | McDonald | 242/129.6 |
| 4,541,586 | 9/1985 | Crowe | 242/594.4 X |
| 4,548,368 | 10/1985 | Tomlinson | 242/179.6 |
| 4,685,633 | 8/1987 | Pellini | 242/598.3 |
| 4,832,271 | 5/1989 | Geleziunas | 242/422.5 |
| 5,263,658 | 11/1993 | Baucom et al. | 242/129.62 |
| 5,316,232 | 5/1994 | Lambert | 242/422.4 |

FOREIGN PATENT DOCUMENTS

| | | | |
|---|---|---|---|
| 2453810 | 11/1980 | France | 242/594.5 |
| 1815761 | 6/1970 | Germany | 242/422.5 |

*Primary Examiner*—John M. Jillions
*Attorney, Agent, or Firm*—J. R. Cwayna

[57] ABSTRACT

A cage for display of and storage of reels of cable, wire, chain, rope and the like having a six sided, wire formed arrangement with the sides thereof providing bearings for an axle upon which the reel rotates for material removal, a movable back section which is biased to provide a brake against free reel rotation and thus uncoiling of the material, a top and bottom and a front with the front providing a pricing or information section and an end receiving element to receive and removeably retain the end of the material during nonuse. The movable back not only acts as a brake but also allows reel mounting without having to physically lift the reel. The cage is also arranged for stacking of like cages.

16 Claims, 5 Drawing Sheets

REEL CAGE

RELATED APPLICATIONS

There are no applications by applicant currently on file in the United States Patent Office related to the invention disclosed in this application.

SPONSORSHIP

This invention is not made under any Federally sponsored research and development arrangement nor under any independently sponsored research and development arrangement.

FIELD OF THE INVENTION

A wire formed cage for mounting reels containing various materials such as wire, chain, rope or the like having a wire frame of six sides with a rear side being rotatable attached between lateral sides with a biasing member working therewith to draw the same inwardly of such sides to work as a brake against the mounted reel and opening to permit the cage to be placed over a reel to locate and position the same within the cage without lifting of the reel. Like cages may be stacked and the cages are individually useable as portable units for use as, for example, cable TV installers.

SHORT SUMMARY OF THE INVENTION

A wire cage forming lateral sides, a front, top and bottom and a rear side with selectively located connective bars joining the lateral sides. The rear side is mounted for rotation between the sides of said bars such that it can be opened for the introduction of a wire, chain, rope of other material containing reel into the cage and which rear side is biased inwardly between the sides and between the reel flanges to act as a brake against the coiled material.

The two lateral sides are provided with axle receiving, wire formed pockets such that, upon placement of a reel into the cage an axle is provided through the reel and is carried in such pockets to allow retarded or braked rotation by the rear side of the reel for controlled removal of the product.

A description or price information receiving member is provided to extend between the lateral sides on the front side of the cage and a material end receiving and retaining member is provided on the front side to receive the end of the coiled material during non-use.

The unit is sized to allow the rearly openable cage to be placed over a reel, the axle inserted through the sides and reel and upon rotation of the entire through 90°, the reel is brought from floor contact to a position of rotation and material removal. The rear side is then brought into closed position and the biasing member is secured to one of the selectively placed bars and the rear side to enable the braking force.

The wire formation includes upwardly directed, handle, cage aligning members such that the filled units are easily lifted and vertically stacked.

BACKGROUND AND OBJECTS OF THE INVENTION

Display and selling of various materials such as wire, chain and rope carried on reels is well know in the art. It is the most convenient method for handling, displaying and sell such material. The buyer or user simply unwinds his or her desired length of material from the reel and cuts the same.

A problem is maintaining a neat looking display due to overunwinding and in the case of wire, self unwinding. Applicant provides a braking mechanism incorporated into a storage, stocking and stackable cage to overcome this problem.

Another problem is the physically handling of such reels not only due their size and configuration, but to weight.

Applicant solves this problem by providing a reel cage which is placed over a reel while the reel rests on a floor, receives a reel mounting axle while on the floor and which cage is then turned 90° to bring the now mounted reel off the ground into rotative position.

The only time the reel must be lifted is to place the same on a shelf, if desired, or to stack like cages upon each other. Handles and a vertical alignment system are incorporated for such stacking use.

It is therefore an object of applicant's invention to provide a formed reel cage for the mounting of material containing reels which allows for reel placement therein without lifting of the reel.

It is a further object of the applicant's invention to provide a formed reel cage for the mounting of material carrying reels which provides for braked reel rotation to prevent undesired unwinding of the material from the reel.

It is yet a further object of the applicant's invention to provide a formed reel cage for the mounting of material carrying reels which provides a free material end retaining member such that the ultimate end of the material is temporarily stored during non-use of the reel.

It is yet a further object of the applicant's invention to provide a formed reel cage for the mounting of material carrying reels which filled cages are easily stackable and positively connected when stacked.

It is yet a further object of the applicant's invention to provide a formed reel cage for the mounting of material carrying reels and which incorporates a pricing and product informational area.

It is still an object of the invention to provide a reel cage for use in transportable requirements such as cable TV installers who require a quantity of cable for individual installations.

These and other objects and advantages of the applicant's invention will more fully appear from a consideration of the accompanying drawings and description.

DESCRIPTION OF A PREFERRED FORM OF THE INVENTION

Figure 1:
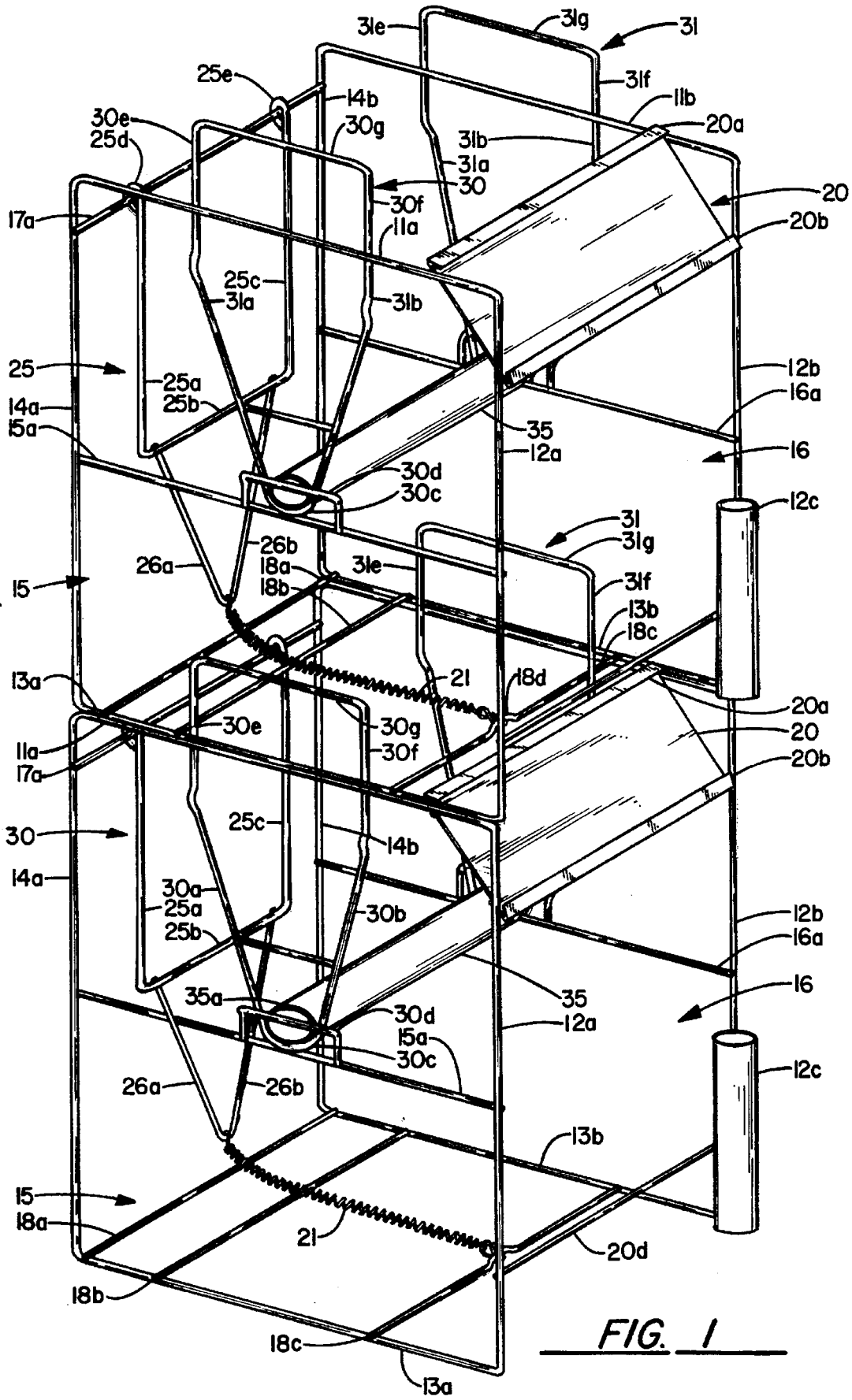
FIG. 1 is a perspective view of a pair of reel cages embodying the concepts of the applicant's invention in stacked relation.
Figure 2:
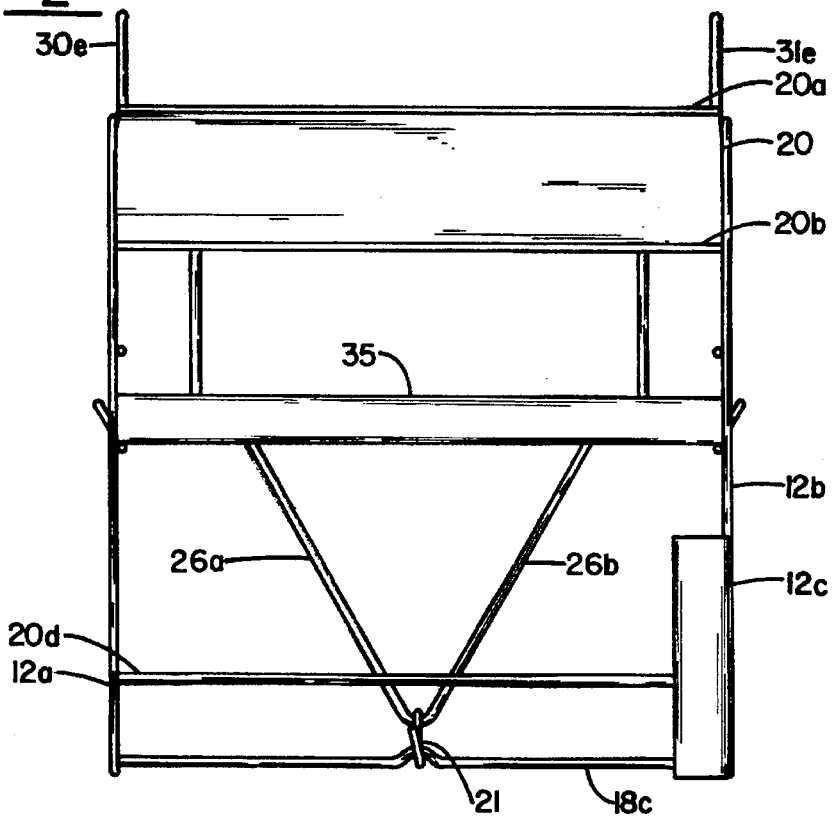
FIG. 2 is a front elevation of the invention.
Figure 3:
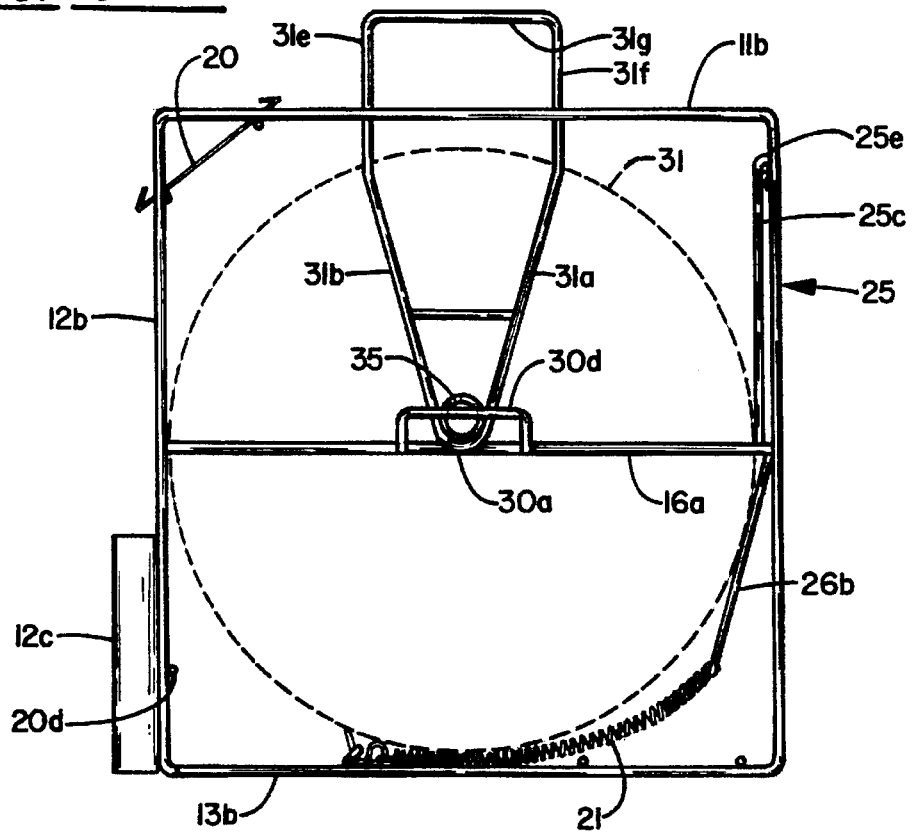
FIG. 3 is a side elevation thereof.
Figure 4:
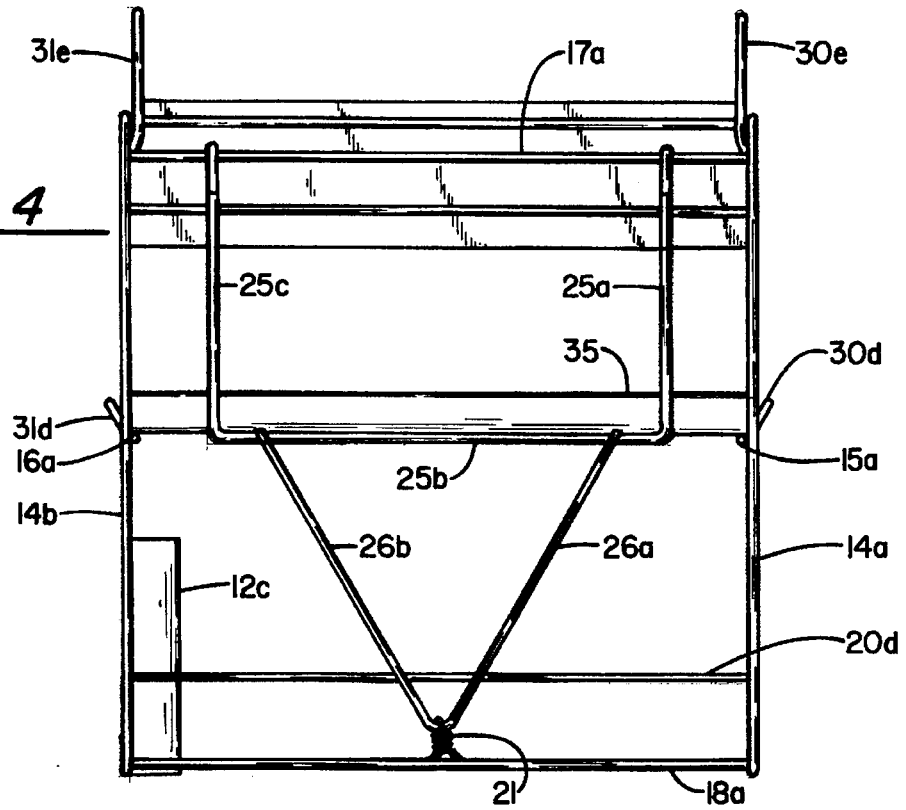
FIG. 4 is a rear elevation thereof with the rear panel closed.
Figure 5:
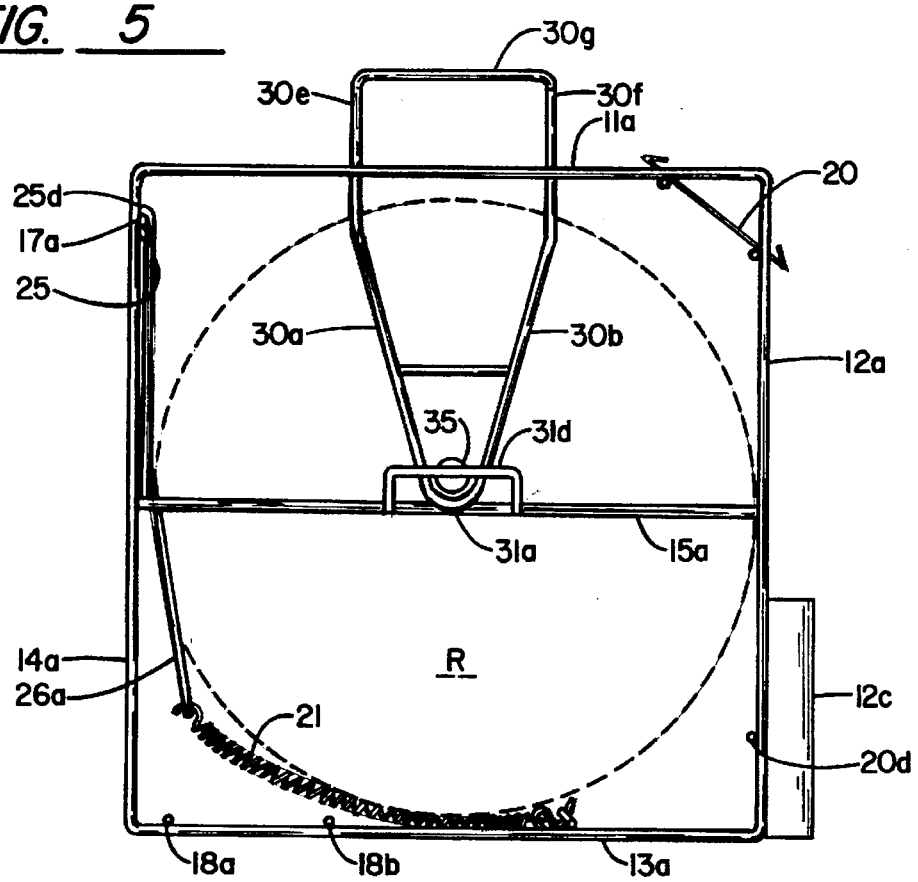
FIG. 5 is a side elevation taken from the side opposite of FIG. 3.
Figure 6:
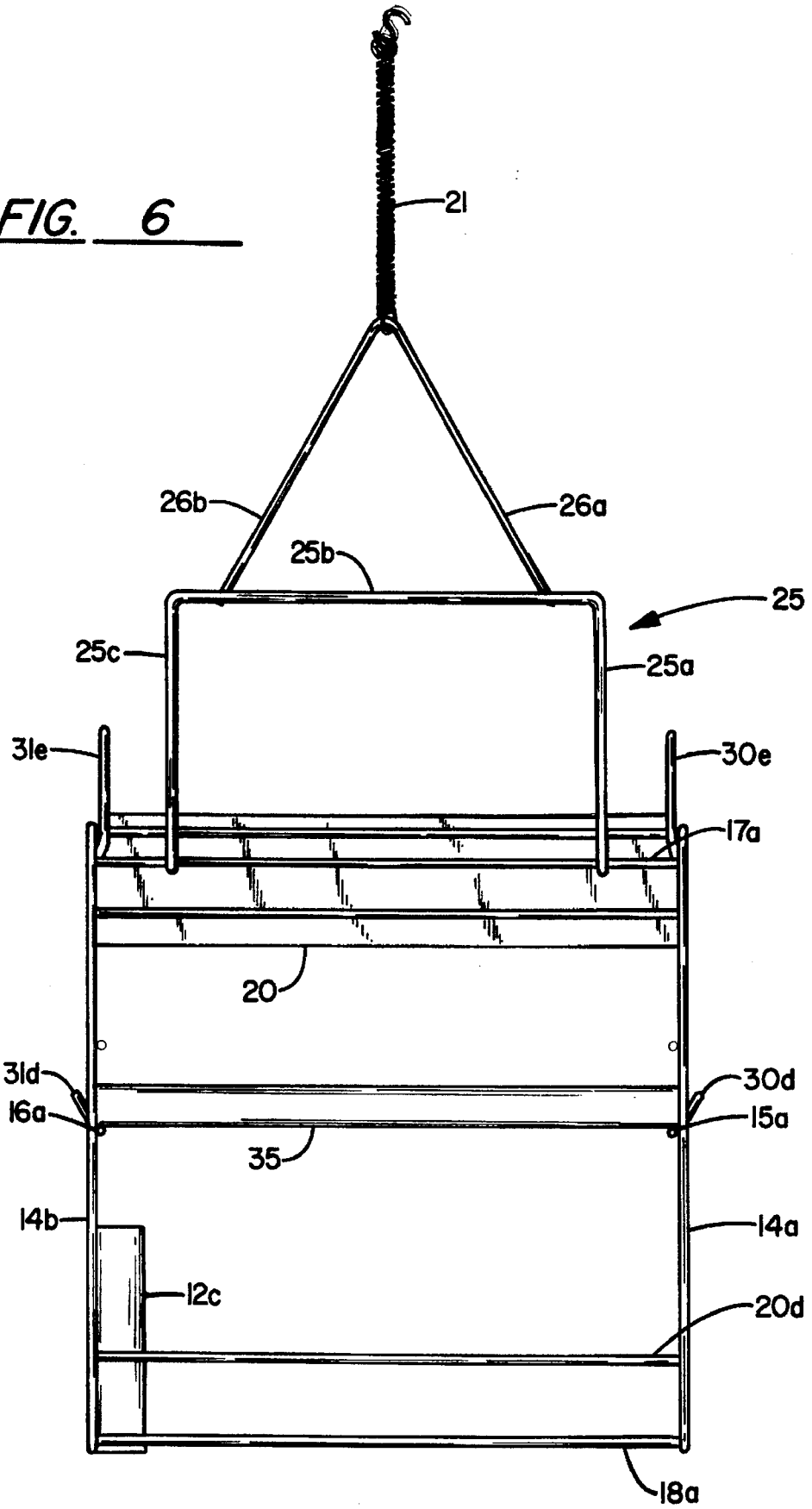
FIG. 6 is a rear elevation thereof with the rear panel open position.

In accordance with the accompanying drawings, the applicant's reel cage is designated in its entirety 10 and is illustrated as a wire formed unit. It should be stated and it should be obvious, that the unit 10 could be formed of connected panels or partial panels without departing from the scope of the invention as the boundary wires simply form planes.

Each aide cage panel includes generally horizontal top boundary wires 11*a*, 11*b*, generally vertical front boundary wires 12*a*, 12*b*, generally horizontal bottom boundary wires 13*a*, 13*b* and vertical rear boundary wires 14*a*, 14*b*. Each set of wires, 11*a*, 12*a*, 13*a*, 14*a* and 11*b*, 12*b*, 13*b*, 14*b* describe the boundaries of the sides 15, 16. A single crosswire or bars 17*a* extends between the back panel side wires 14*a*, 14*b*. Single spanning wires or bars 15*a*, 16*a* extend between side boundary wires 12*a*, 14*a* and 12*b*, 14*b*. A front display panel 20 is arranged between wire elements 11*a*, 11*b* and 12*a*, 12*b* so as to position panel 20 angularly to the unit and to be visible from the front of the unit 10. As illustrated, panel 20 may be provided with cupped, card receiving areas 20*a*, 20*b* at the edges thereof to retain information receiving cards therein. An additional, front spanning wire 20*d* is provided between side wire elements 12*a*, 12*b*.

The bottom area of the unit 10 is provided with, in the form shown, three cross wires 18*a*, 18*b*, 18*c* with cross wire 18*c* being provided with a centrally located notch or bend portion 18*d* to receive one end of a biasing member 21 therein.

The rear of the unit provides a wire structure including a generally rectangular portion 25 of three legs 25*a*, 25*b*, 25*c*. Two of such legs 25*a*, 25*c* are formed to, as at 25*d*, 25*e* provide rotatable connections to cross wire 17*a* and the spacing between such legs 25*a*, 25*c* is designed to permit the panel 25 to be received between the flanges of a reel R which is received into the cage 10. A triangular wire form consisting of legs 26*a*, 26*b* is secured to the third leg 25*b* of rectangular portion 25. The other end of biasing member 20 is secured to the junction point of such two legs 26*a*, 26*b*. This biasing arrangement, with the lateral size of this back unit then provides a rotatable member which may be shifted between a position which entirely opens the unit 10 to receive a reel R and a position where it is biased between the flanges of the reel R against the material carried by the reel R to brake the same against rotation.

A material end receiving and containing, in the form shown, tubular member 12*c* is provided on wire element 12*b* to receive the end of material from the reel R and prevent it from extending, for example, into a store aisle.

It should be noted that the dimension between cross wires 18*b*, 18*c* is a selected dimension, as will be described, for cage stacking purposes.

The structure provided for reel R, rotatable mounting is arranged on the side panels 15, 16 and the wires describing the same. In their entirety, they are designated 30, 31 and each consists of a triangular, two legged 30*a*, 30*b* and 31*a*, 31*b* section meeting in a curved junction 30*c*, 31*c*. For strength reasons, the curved junctions 30*c*, 31*c* are secured to cross wires 15*a*, 16*a*. Outboard of such curved sections 30*c*, 31*c* an axle stop, wire brace 30*d*, 31*d* is provided to secure a reel mounting axle 35 against side movement. The curved areas 30*c*, 31*c* serve as pockets for such axle 35 and the axle 35 may be provided with reduced diameter areas 35*a*, 35*b* to also prevent side movement of a seated axle 35.

As illustrated, the two legged 30*a*, 30*b* and 31*a*, 31*b* sections extend upwardly above top wire elements 11*a*, 11*b* as at 30*e*, 30*f* and 31*e*, 31*f* to a top handle 30*g*, 31*g* extending therebetween.

The spacing between lower side cross wires 18*b*, 18*c* and the length of handles 30*g*, 31*g* is determined for stacking of the units 10. The handles 30*g*, 31*g* and portions of wires 30*e*, 30*f* 31*e*, 31*f* fit between such cross wires 18*b*, 18*c*.

Figure 7:
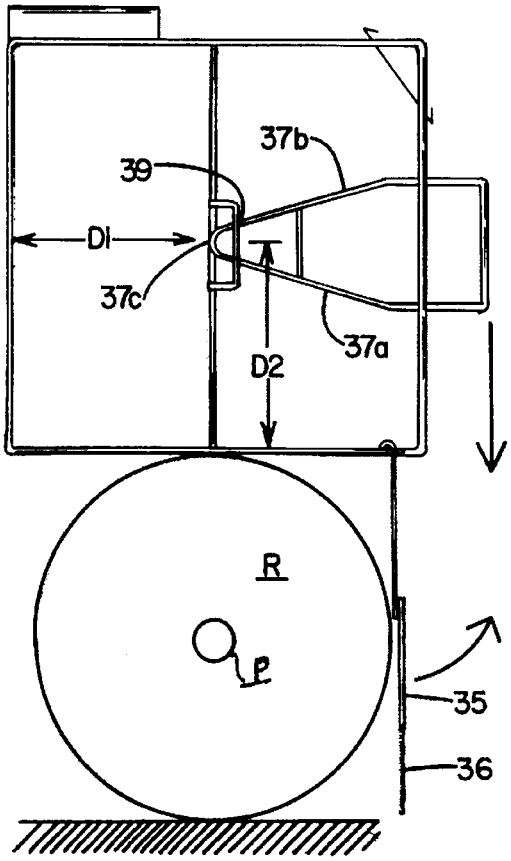
FIGS. 7, 8 and 9 are sequential views illustrating the loading of a reel into the cage.
Figure 8:
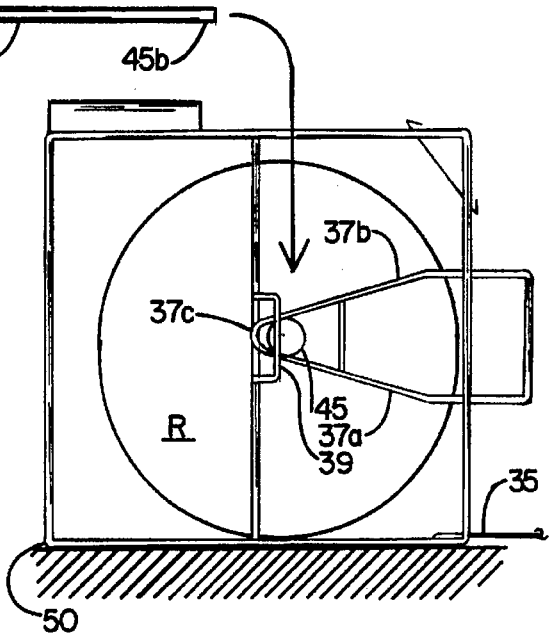
Figure 9:
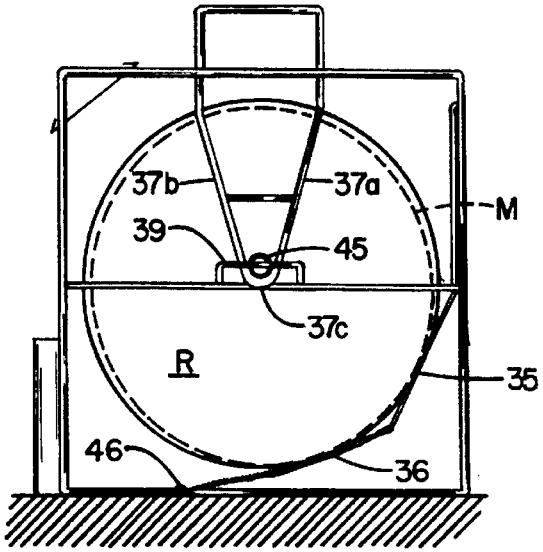

The method for loading the cage 10 with a reel R is illustrated in FIGS. 7, 8 and 9. In these views, individual wire numbers are eliminated for the sake of clarity and new numerals are introduced. Only one side of the cage 10 is illustrated.

As illustrated in FIG. 7, the rear door or braking panel 35 is opened by releasing biasing member 36. This allows the open cage 10 to be placed over the top of the reel R and similarly rest on the floor, panel 35 being swung to its openmost position. A slight shifting of the cage 10 to the left will expose the passage P through the reel R in the triangular leg area defined by legs 37*a*, 37*b*. At this point, FIG. 8, the axle 45 is inserted through the cage 10 and reel R and the entire unit 10 is tipped to the position of FIG. 9. It should be noted, that in this position, the reel R is suspended and carried by axle 35 in the pockets 37*c*. Grooves 45*a*, 45*b* in rod 45 and wire members 39 assist in holding the rod 45 against sideways movement.

This eliminates any lifting of the reel to load into a cage and only requires turning of the loaded cage.

Rear or braking panel 35 may be swung into and locked into cage closing position at any time the reel is properly located and is brought into material braking position by attaching biasing member 36 to notched cross wire 46. This biasing will bring the panel 35 against the material of reel R as the lateral size of the panel 35 permits the same to move between the flanges of the reel R.

It should be obvious that the sizing of the unit permits the the same to be placed over a reel, the rod 45 to be inserted through the reel R with its location being between the arms 37*a*, 37*b* of the unit and in relation to receiving pockets 35*c* such that when the unit is rotated upon corner 50 and into the position of FIG. 9, the reel R will be free to rotate. To obtain this relation, the dimension D1, must be greater than dimension D2 as shown in FIG. 7.

Cages or units 10 may be stacked by simply lifting one above the other and engaging the upstanding handle portion of the lower cage into the provided wire spacing of the bottom of the upper cage.

Similarly, the unit is individually useable as it is easily transportable from job site to job site with the reel being locked in the cage through closure of the rear panel 25. A typical use would be cable TV installers or any other use where a quantity of wire or cable, etc. must be used on a job site.

It should be obvious that applicant has provided a new and unique reel cage which allows loading of reels without lifting of the same, provides a unique braking system for the reel and thus the material carried thereon, provides a stacking system for reels as well as an easily transportable unit and also provides a material end retaining unit such that the reel material will not uncoil from the reel to provide an unsafe or untidy area.

What is claimed is:

1. A reel cage for rotatably mounting material carrying, flanged reels arranged for the removal of material from the reels, such cage including:

a. a pair of spaced side panels generally rectangular in shape;

b. a plurality of bars extending between and connected to said side panels;

c. a rear panel pivotally secured to one of said bars and being of a width to be less than the dimension between the flanges of the reel whereby it is contactable with the material on the reel;

d. biasing means holding said rear panel against the reel material for braking the rotation of the reel and removal of material therefrom;

e. said rear panel being shiftable to allow a reel to be received between said side panels; and f. means for rotatably mounting a reel between said side panels.

2. The reel cage as set forth in claim 1 and said biasing means being connectable to one of said bars and releasable therefrom to allow said rear panel said rear panel to shift whereby the cage may be placed over a standing reel.

3. The reel cage as set forth in claim 1 and said third panel being rotatably mounted between said spaced side panels on said rear edge and adjacent said top edge thereof.

4. The reel cage as set forth in claim 1 and;

a. a bottom panel provided between said bottom edges of said spaced side panels;

b. an upstanding handle and locating member provided at said top edge of each of said spaced side panels, extending upwardly therefrom; and, c. means provided on said bottom panel to receive said upstanding handle and locating member therein whereby like reel cages may be stacked in vertical fashion.

5. The reel cage as set forth in claim 1 and a material end retaining member arranged on one of said spaced side panels to receive and temporarily retain the accessible end of material carried by the reel.

6. The reel cage as set forth in claim 5 and said material end retaining member arranged on a front edge of one of said spaced side panels.

7. The reel cage as set forth in claim 5 wherein said material end retaining member includes a tubular member secured to said front edge of one of said spaced side panels.

8. The reel cage as set forth in claim 1 and a display holding member arranged between said front edges of said spaced side panels.

9. The reel cage as set forth in claim 8 and said display holding member being arranged adjacent said top edges thereof.

10. The reel cage as set forth in claim 1 and said side panels each providing a rod receiving socket to receive said reel mounting rod therein.

11. The reel cage as set forth in claim 10 and said sockets being formed respectively in said side panels to permit said rod to be passed through one of said sides, passed through the reel and be received in the other of said sides.

12. The reel cage as set forth in claim 11 and said sockets being provided in said side panels at a first pedetermined dimension from said bottom edge thereof and at a second, greater dimension from said rear edge of said panel.

13. The reel cage as set forth in claim 1 and said panels being defined solely by formed and connected wires to provide an open cage.

14. The reel cage as set forth in claim 1 and said panels being defined solely by formed and connected wires to provide an open cage.

15. The reel cage as set forth in claim 3 and said panels being defined solely by formed and connected wires to provide an open cage.

16. The reel cage as set forth in claim 4 and said panels, handle and locating member being defined by formed and connected wires to provide an open cage.

* * * * *